US011518649B2

(12) United States Patent
Koide

(10) Patent No.: US 11,518,649 B2
(45) Date of Patent: Dec. 6, 2022

(54) ELEVATOR DERAILMENT DETECTING DEVICE

(71) Applicant: Mitsubishi Electric Corporation, Tokyo (JP)

(72) Inventor: Kazuaki Koide, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 574 days.

(21) Appl. No.: 16/493,756

(22) PCT Filed: Apr. 27, 2017

(86) PCT No.: PCT/JP2017/016803
§ 371 (c)(1),
(2) Date: Sep. 13, 2019

(87) PCT Pub. No.: WO2018/198283
PCT Pub. Date: Nov. 1, 2018

(65) Prior Publication Data

US 2020/0048038 A1 Feb. 13, 2020

(51) Int. Cl.
*B66B 5/00* (2006.01)
*H01H 35/02* (2006.01)
*B66B 17/12* (2006.01)

(52) U.S. Cl.
CPC ..... *B66B 5/0031* (2013.01); *H01H 35/02* (2013.01); *B66B 17/12* (2013.01); *H01H 2231/03* (2013.01)

(58) Field of Classification Search
CPC ..... B66B 5/0031; B66B 17/12; B66B 5/00; B66B 5/06; H01H 35/02
USPC ..... 187/247, 292, 393, 394
See application file for complete search history.

(56) References Cited

U.S. PATENT DOCUMENTS

2012/0024636 A1* 2/2012 Niikawa ..... B66B 5/02 187/391
2012/0097487 A1* 4/2012 Winey ..... B66B 5/021 187/393
2014/0027210 A1* 1/2014 Rogers ..... B66B 5/0031 187/393

FOREIGN PATENT DOCUMENTS

GB 2339076 A * 1/2000 ..... H01H 35/02
JP 61-90981 A 5/1986
JP 2010-18423 A 1/2010
JP 2012-533496 A 12/2012
(Continued)

OTHER PUBLICATIONS

International Search Report and Written Opinion dated Jul. 18, 2017 for PCT/JP2017/016803 filed on Apr. 27, 2017, 8 pages including English Translation of the International Search Report.

*Primary Examiner* — Edwin A. Leon
*Assistant Examiner* — Iman Malakooti
(74) *Attorney, Agent, or Firm* — Xsensus LLP

(57) ABSTRACT

An elevator derailment detecting device according to the present invention detects the opened and closed states of contacts at first and second safety relays 82 and 83 (steps S1 and S2). Since a first NO contact 82*b* is closed, a first NC contact 82*c* is opened, a second NO contact 83*b* is closed, and a second NC contact 83*c* is opened, it is determined that there is no circuit failure. Then, the opened and closed state of the contactless relay 84 is detected (step S3). When the contactless relay NO contact 84*b* is closed and the contactless relay NC contact 84*c* is opened, it is determined that the counterweight 21 of the elevator 11 is in a derailed state.

18 Claims, 4 Drawing Sheets

(56) References Cited

FOREIGN PATENT DOCUMENTS

| | | | |
|---|---|---|---|
| WO | 2011/010376 | A1 | 1/2011 |
| WO | 2014/188051 | A1 | 11/2014 |

* cited by examiner

ELEVATOR DERAILMENT DETECTING DEVICE

CROSS-REFERENCE TO RELATED APPLICATIONS

The present application is based on PCT filing PCT/JP2017/016803, filed Apr. 27, 2017, the entire contents of which are incorporated herein by reference.

TECHNICAL FIELD

The present invention relates to a derailment detecting device for an elevator having an ascending and descending part guided on guide rails.

BACKGROUND ART

In an elevator in general, ascending and descending bodies such as a cage and a counterweight are lifted and lowered as being guided on guide rails provided in the lifting and lowering direction. In an elevator derailment detecting device disclosed in PTL 1, a conductor wire through which weak current is passed is provided in the vicinity of and parallel to a guide rail. When the ascending and descending body is derailed from the guide rail, the contacting part provided at the ascending and descending body contacts the conductor wire and conducts electricity, the weak current passed through the conductor wire changes, and the current change is detected by a current detector connected to the conductor wire, so that the derailment of the ascending and descending body can be detected.

CITATION LIST

Patent Literature

[PTL 1] Japanese Patent Application Publication No. 2010-18423

SUMMARY OF INVENTION

Technical Problem

However, when the elevator derailment detecting device disclosed in PTL 1 is provided in a building requiring a high lift height, each guide rail is prolonged for the entire elevator, which also prolongs the entire conductor wire, so that the conductor wire from the position of the ascending and descending body to the current detector is prolonged, and the electric resistance of the conductor wire to be detected increases. The electric resistance of the conductor wire may be instable if the conductor wire corrodes. This may make it difficult to detect change in weak current passed through the conductor wire.

The present invention is directed to a solution to the foregoing problem, and it is an object of the present invention to provide an elevator derailment detecting device which can surely detect derailment of an ascending and descending body from a guide rail.

Solution to Problem

In order to solve the problem, an elevator derailment detecting device according to the present invention includes an ascending and descending part, a guide rail which guides the ascending and descending part to be lifted and lowered, first and second conductor wires provided parallel to a direction in which the ascending and descending part is lifted and lowered, a contacting means as a conductor provided at the ascending and descending part and positioned near the first and second conductor wires, a first DC power supply unit which applies a first DC voltage to the first conductor wire, and a second DC power supply unit which applies a second DC voltage to the second conductor wire, and a different voltage detector which detects a voltage at the second conductor wire, the first and second DC voltages have different values, and the contacting means contacts the first and second guide wires when the ascending and descending part is derailed from the guide rail, so that a DC voltage generated at the second conductor wire is detected by the different voltage detector.

Advantageous Effects of Invention

The elevator derailment detecting device according to the present invention includes the first and second conductor wires provided parallel to the direction in which the ascending and descending part is lifted and lowered, the contacting means as a conductor provided at the ascending and descending part and positioned near the first and second conductor wires, the first DC power supply unit which applies the first DC voltage to the first conductor wire, and the second DC power supply unit which applies the second DC voltage to the second conductor wire, and the different voltage detector which detects a voltage at the second conductor wire, and the contacting means contacts the first and second guide wires when the ascending and descending part is derailed from the guide rail, so that a DC voltage generated at the second conductor wire is detected by the different voltage detector and therefore the derailment of the ascending and descending part can be surely detected.

DESCRIPTION OF EMBODIMENTS

Embodiments

Now, an embodiment of the present invention will be described in conjunction with the accompanying drawings.

Figure 1:
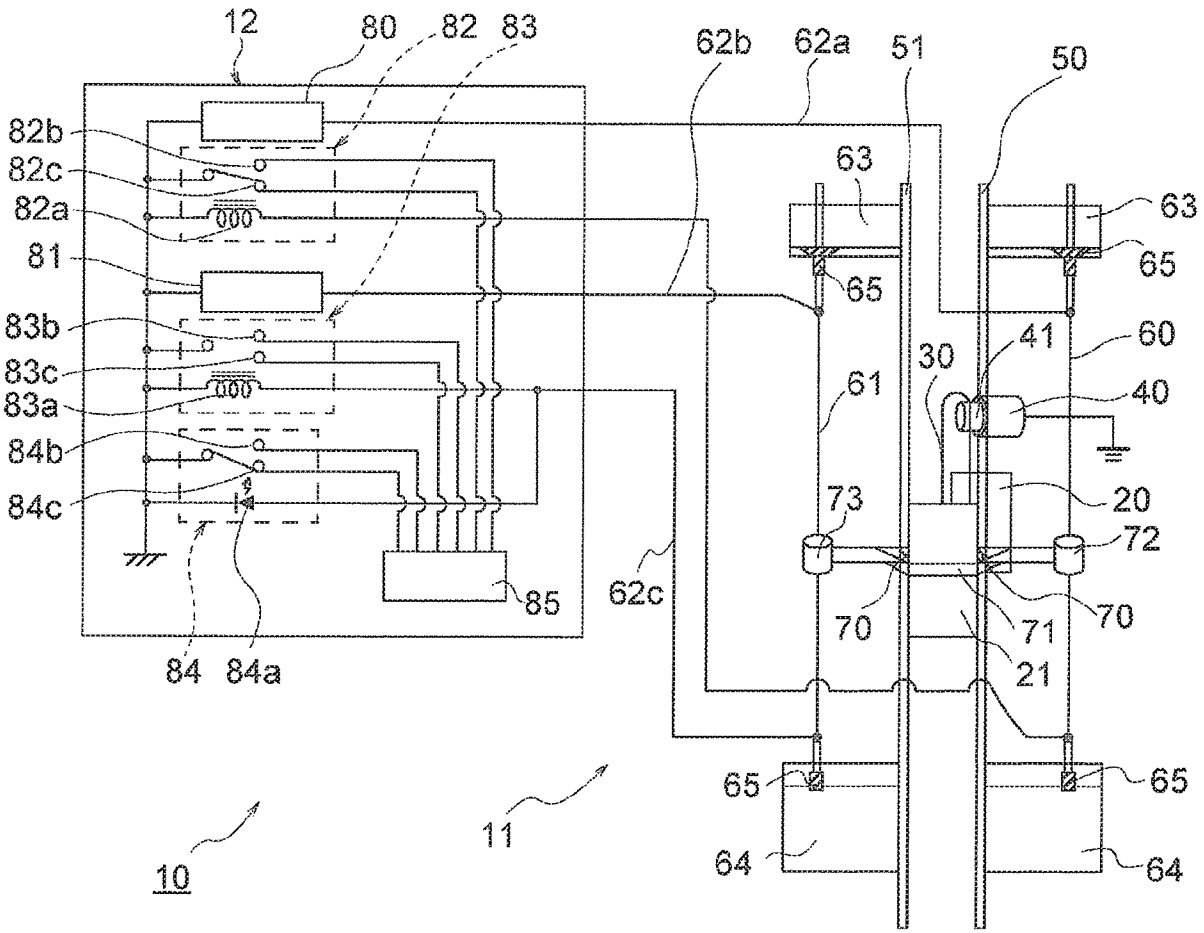
FIG. 1 is a schematic view of an elevator system according to an embodiment of the present invention.

FIG. 1 is a schematic view of the structure of an elevator system according to the embodiment of the present invention.

The elevator system 10 includes a traction type elevator 11 and an elevator control board 12 having a device which controls the elevator 11. The elevator 11 includes a cage 20 and a counterweight 21 connected by a rope 30, the cage 20 can carry occupants, luggage, etc., and the counterweight 21 has a weight close to the weight of the cage 20 so that the weight counterbalances the cage 20. The rope 30 is placed around the driving part 41 of a hoisting machine 40, and the cage 20 and the counterweight 21 are suspended through the rope 30 in a substantially balanced state. The hoisting machine 40 includes a motor (not shown) as a motive power source for hoisting.

When the rope 30 is hoisted by the hoisting machine 40, the counterweight 21 is raised and lowered as being guided on first and second guide rails 50 and 51, so that the cage 20 is raised and lowered as being guided on a guide rail (not shown). The counterweight 21 forms an ascending and descending part.

A first conductor wire 60 is provided parallel to the first guide rail 50 in the lifting and lowering direction of the counterweight 21, and a second conductor wire 61 is provided parallel to the second guide rail 51. The first and second conductor wires 60 and 61 are attached, through conductor wire insulators 65, to upper end fixed parts 63 provided in the vicinity of the upper ends of the first and second guide rails 50 and 51 and lower end fixed parts 64 provided in the vicinity of the lower ends of the first and second guide rails 50 and 51. In this way, the first and second conductor wires 60 and 61 are provided linearly without slackness under prescribed tension. Note that the first and second conductor wires 60 and 61 are made of a highly conductive material with high corrosion resistance, while the first and second conductor wires 60 and 61 may be coated with a material with high corrosion resistance.

Contacting means 71 is attached to the counterweight 21 through an insulator 70. The insulator 70 forms insulating means. The contacting means 71 is made of a carbon steel which is a highly conductive conductor. The contacting means 71 includes first and second contacting arms 72 and 73 at a prescribed distance. The first contacting arm 72 surrounds the first conductor wire 60, and the second contacting arm 73 surrounds the second conductor wire 61. More specifically, the first contacting arm 72 is provided in the vicinity of the first conductor wire 60, and the second contacting arm 73 is provided in the vicinity of the second conductor wire 61. Note that the contacting means 71 may be made of a material with high corrosion resistance other than the carbon steel or may be provided with a highly conductive coating with high corrosion resistance.

The elevator control board 12 includes a first DC power supply device 80, a second DC power supply device 81, a first safety relay 82, a second safety relay 83, a contactless relay 84, and a relay detector 85. The first DC power supply device 80 is a constant voltage power supply device which outputs a DC voltage of 24 V in response to input of a DC voltage of 48 V from a DC power supply which is not shown and forms a first DC power supply unit. The second DC power supply device 81 is a constant voltage power supply device which outputs a DC voltage of 12 V in response to input of a DC voltage of 48 V from a DC power supply which is not shown and forms a second DC power supply unit.

The first and second safety relays 82 and 83 are known contact relays generally called forced guided contact relays. The contactless relay 84 is a known contactless relay and advantageous in that the relay is less prone to a contact failure caused by corrosion. The contactless relay 84 is connected with an overcurrent circuit breaker (not shown) for detecting a short circuit attributable to a failure related to semiconductor therein.

The first DC power supply device 80 has its output connected to the upper end of the first conductor wire 60 through a first electric wire 62*a*. The first conductor wire 60 has its lower end connected with a first coil 82*a* as the input side coil of the first safety relay 82. The first safety relay 82 includes a first NO (normally open) contact 82*b* and a first NC (normally closed) contact 82*c*, and each of the contacts is connected with the relay detector 85 capable of detecting which contact is opened and closed between the first NO contact 82*b* and the first NC contact 82*c*. The input voltage up to a DC voltage of 24 V to the first coil 82*a* of the first safety relay 82 can open and close the contact of the first safety relay 82 without a failure. The first safety relay 82 forms a first failure detector.

The second DC power supply device 81 has its output connected to the upper end of the second conductor wire 61 through a second electric wire 62*b*. The second electric wire 62*b* has a length which is substantially equal to the length of the first electric wire 62*a*. A second coil 83*a* as the input side coil of the second safety relay 83 and an input element 84*a* for switching the contactless relay 84 are connected in parallel to the lower end of the second conductor wire 61 through a third electric wire 62*c*. The length of the wire from the lower end of the second conductor wire 61 to the second coil 83*a* is substantially equal to the length of the wire from the lower end of the first conductor wire 60 to the first coil 82*a*. The first electric wire 62*a*. the second electric wire 62*b*, and the third electric wire 62*c* are each made of a known highly conductive material.

The second safety relay 83 includes a second NO contact 83*b* and a second NC contact 83*c*, and each of the contacts is connected to the relay detector 85 capable of detecting which contact is opened and closed between the second NO contact 83*b* and the second NC contact 83*c*. The contactless relay 84 includes a contactless relay NO contact 84*b* and a contactless relay NC contact 84*c* (which are not contacts to be exact while described as being equivalent to contact relays for the ease of description), and each of the contacts is connected to the relay detector 85 capable of detecting which contact is opened and closed between the contactless relay NO contact 84*b* and the contactless relay NC contact 84*c*.

The second safety relay can open and close a contact when input voltage to the second coil 83*a* is a DC voltage in the range from 12 V to 24 V. The contactless relay 84 needs only be a relay which does not operate to open and close a contact when input voltage to the input element 84*a* is a DC voltage of 12 V and has operation voltage set in the range up to a DC voltage of 24 V as a maximum voltage. The second safety relay 83 forms a second failure detector, and the contactless relay 84 forms a different voltage detector.

Figure 2:
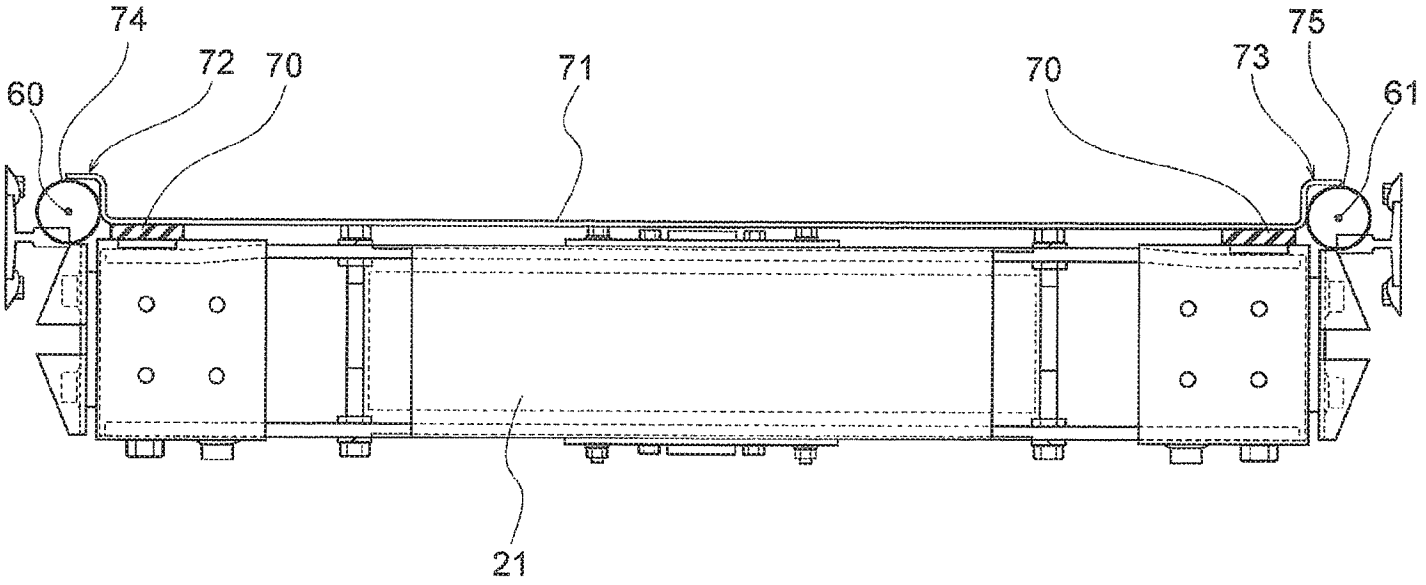
FIG. 2 is a top view of contacting means shown in FIG. 1.

As shown in FIG. 2, the first contacting arm 72 provided at the contacting means 71 has a first cylindrical part 74, and the second contacting arm 73 has a second cylindrical part 75. The first and second cylindrical parts 74 and 75 are each formed to have a substantially cylindrical shape as viewed from the lifting and lowering direction of the counterweight 21. When the counterweight 21 is not derailed from the first guide rail 50 or the second guide rail 51, the first conductor wire 60 is in the vicinity of the inner side of the first cylindrical part 74 while being kept from contacting the first cylindrical part 74, and the second conductor wire 61 is in the vicinity of the inner side of the second cylindrical part 75 while being kept from contacting the second cylindrical part 75. Therefore, the first conductor wire 60 and the second conductor wire 61 are not electrically connected with each other.

The first and second contacting arms 72 and 73 are provided so that the first cylindrical part 74 of the first contacting arm 72 contacts the first conductor wire 60 and the second cylindrical part 75 of the second contacting arm 73 contacts the second conductor wire 61 when the counterweight 21 is derailed from the first guide rail 50 or the second guide rail 51. The contacting means 71 is made of a carbon steel, and therefore when the counterweight 21 is derailed from the first guide rail 50 or the second guide rail 51, the first conductor wire 60 and the second conductor wire 61 are electrically connected with each other through the contacting means 71.

Now, operation according to the embodiment of the present invention will be described with reference to FIGS. 1 to 4.

As shown at A1 in FIG. 3, operation carried out when the elevator system 10 (see FIG. 1) is normally operated by fully automated operation will be described. As shown in FIG. 1, during fully automated operation, the hoisting machine 40 is driven to lift and lower the cage 20 and the counterweight 21. At the time, the counterweight 21 is lifted and lowered while being guided on the first guide rail 50 and the second guide rail. Since the first contacting arm 72 (see FIG. 2) is not in contact with the first conductor wire 60 and the second contacting arm 73 is not in contact with the second conductor wire 61, the first conductor wire 60 and the second conductor wire 61 are not electrically connected with each other.

A DC voltage of 24 V output by the first DC power supply device 80 is applied to the first coil 82*a* through the first conductor wire 60. The first safety relay 82 can operate with input voltage to the first coil 82*a* up to 24 V, the first NO contact 82*b* is closed while the first NC contact 82*c* is opened (see A2 in FIG. 3). Also as shown in the flowchart in FIG. 4, the state is detected by the relay detector 85 (see step S1 in FIG. 4).

A DC voltage of 12 V output by the second DC power supply device 81 is applied to the second coil 83*a* through the second conductor wire 61. The second safety relay 83 can operate when input voltage to the second coil 83*a* is 12 V, and therefore the second NO contact 83*b* is closed while the second NC contact 83*c* is opened (see A3 in FIG. 3). The state is detected by the relay detector 85 (see step S2 in FIG. 4).

Then, a DC voltage of 12 V output by the second DC power supply device 81 is applied to the input element 84*a* through the second conductor wire 61. The contactless relay 84 does not operate when the input voltage to the input element 84*a* is 12 V, and therefore the contactless relay NO contact 84*b* is opened while the contactless relay NC contact 84*c* is closed (see A4 in FIG. 3). The state is detected by the relay detector 85 (see step S3 in FIG. 4).

When the contactless relay NO contact 84*b* is opened, and the contactless relay NC contact 84*c* is closed, there is a possibility that a short circuit may be caused by a failure in the semiconductor device of the contactless relay 84 in addition to the input voltage to the input element 84*a* being less than the operation voltage as described above. In the normally operated state, no short circuit is caused at the contactless relay 84, and therefore the overcurrent circuit breaker of the contactless relay 84 does not interrupt the circuit (see A5 in FIG. 3). The relay detector 85 determines that the overcurrent circuit breaker does not interrupt the circuit (see step S5 in FIG. 4). It is determined that the elevator 11 is in the normally operated state unless the circuit is interrupted by the overcurrent circuit breaker.

Figure 3:
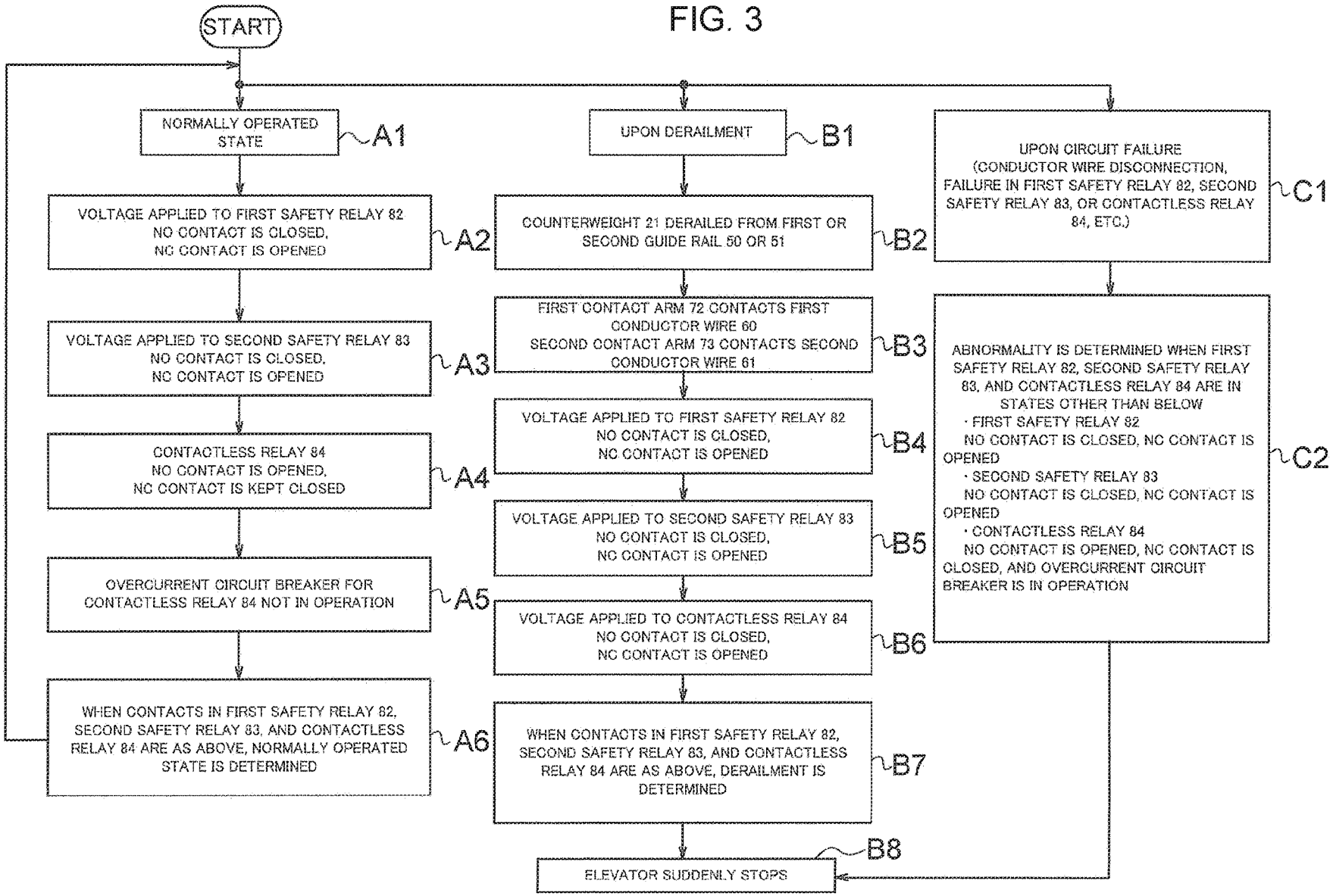
FIG. 3 is a schematic block diagram showing the operation of the elevator system shown in FIG. 1.

The first safety relay 82, the second safety relay 83, and the contactless relay 84 are in the states A2, A3, A4, and A5 in FIG. 3 as described above, the elevator 11 is in the normally operated state (see A6 in FIG. 3). In this case, the fully automated operation of the elevator 11 is continued.

Now, operation carried out when the counterweight 21 is derailed from the first guide rail 50 or the second guide rail 51 (in the event of derailment) will be described (see B1 in FIG. 3). When the counterweight 21 is derailed from the first guide rail 50 or the second guide rail 51, the counterweight 21 is inclined and the contacting means 71 is inclined accordingly (see B2 in FIG. 3). As shown in FIG. 2, the first contacting arm 72 surrounds the first conductor wire 60 and the second contacting arm 73 surrounds the second conductor wire 61, so that the first conductor wire 60 contacts the first cylindrical part 74 and the second conductor wire 61 contacts the second cylindrical part 75 regardless of the inclination direction of the contacting means 71 (see B3 in FIG. 3). The contacting means 71 is made of a conductor, and therefore the first conductor wire 60 and the second conductor wire 61 are electrically connected with each other through the contacting means 71.

As shown in FIG. 1, the length of the first electric wire 62*a* and the first conductor wire 60 from the output of the first DC power supply device 80 to the position of the first conductor wire 60 contacted by the contacting means 71 is substantially equal to the length of the second electric wire 62*b* and the second conductor wire 61 from the output of the second DC power supply device 81 to the position of the second conductor wire 61 contacted by the contacting means 71. The first and second electric wires 62*a* and 62*b* and the first and second conductor wires 60 and 61 are of the same material and therefore have the same resistance value per length. Therefore, when a voltage drop, which is caused with respect to the output voltage of 12 V from the second DC power supply device 81, between the output of the second DC power supply device 81 and the position of the second conductor wire 61 in contact with the contacting means 71 is Vd, a voltage drop, which is caused with respect to the output voltage of 24 V from the first DC power supply device 80, between the output of the first DC power supply voltage device 80 and the position of the first conductor wire 60 in contact with the contacting means 71 is Vd×2.

The voltage drops Vd and Vd×2 are attributable to the resistance of the first conductor wire 60, the second conductor wire 61, the first electric wire 62*a*, and the second electric wire 62*b*, while the first conductor wire 60, the second conductor wire 61, the first electric wire 62*a*, and the second electric wire 62*b* each made of a highly conductive material have sufficiently small resistance, so that the value of voltage drop Vd can be sufficiently small.

Here, when a voltage drop between the first conductor wire 60 and the second conductor wire 61 caused by the contacting means 71 is Vc, and the following expression (1) is satisfied, voltage from the first DC power supply voltage 80 is applied to the second conductor wire 61.

[Math. 1]

$$24-2\times Vd-Vc>12-Vd \quad (1)$$

When a voltage drop between the contacting means 71 and the contactless relay 84 is Ve, the operation voltage for the contactless relay 84 is Vr, and the following expression (2) is satisfied, input voltage to the input element 84*a* as the first conductor wire 60 and the second conductor wire 61 are electrically connected with each other through the contacting means 71 exceeds the operation voltage Vr for the contactless relay 84, so that the contactless relay 84 operates to close the second NO contact 84*b* and open the second NC contact 84*c*.

[Math. 2]

$$24-2\times Vd-Vc-Ve>Vr \quad (2)$$

When the voltage drop Vc caused by the contacting means 71 is considered, the contacting means 71 made of a carbon steel has an electrical resistivity of 16.9 (μΩ·cm). Therefore, when the contacting means 71 has a length L (m) and a sectional area S ($mm^2$), the resistance R of the contacting means 71 is obtained from the following expression (3).

[Math. 3]

$$R=16.9\times L/S\times 0.01 \quad (3)$$

As shown in FIG. 2, the length L is substantially equal to the lateral length of the counterweight 21 and about 1 m in general, the sectional area S is sufficiently large for the length L, the resistance R is small, and the voltage drop Vc can be sufficiently small.

The voltage drop Ve is attributable to the resistance of the second conductor wire 61 and the third electric wire 62*c* between the contacting means 71 and the contactless relay 84, while the second conductor wire 61 and the third electric wire 62*c* are each made of a highly conductive material and has sufficiently small resistance, so that the value of the voltage drop Ve can be sufficiently small.

Since the voltage drops Vd and Ve are sufficiently small and do not influence the opened and closed states of the first and second safety relays 82 and 83 as shown in FIG. 3, the first NO contact 82*b* is closed (see B4 in FIG. 3) and the first NC contact 82*c* is opened similarly to the normally operated state. Meanwhile, the second NO contact 83*b* is closed, and the second NC contact 83*c* is opened (see B5 in FIG. 3).

Since the voltage drops Vc and Vd are sufficiently small, and the operation voltage Vr for the contactless relay 84 is more than a DC voltage of 12 V and at most a DC voltage of 24 V as an upper limit, the conditions defined by the expressions (1) and (2) are satisfied. Therefore, the contactless relay 84 operates to close the contactless relay NO contact 84*b* and open the contactless relay NC contact 84*c* (see B6 in FIG. 3).

The relays each operate as described above, and the relay detector 85 detects the opened and closed state of each of the contacts at the first and second safety relays 82 and 83. It is determined that there is no circuit failure since the first NO contact 82*b* is closed, the first NC contact 82*c* is opened, the second NO contact 83*b* is closed, and the second NC contact 83*c* is opened (see steps S1 and S2 in FIG. 4). Then, the relay detector 85 detects the opened and closed state of the contactless relay 84 (see step S3 in FIG. 4). It is determined that the counterweight 21 of the elevator 11 is in a derailed state since the contactless relay NO contact 84*b* is closed and the contactless relay NC contact 84*c* is opened (see step S6 in FIG. 4).

Figure 4:
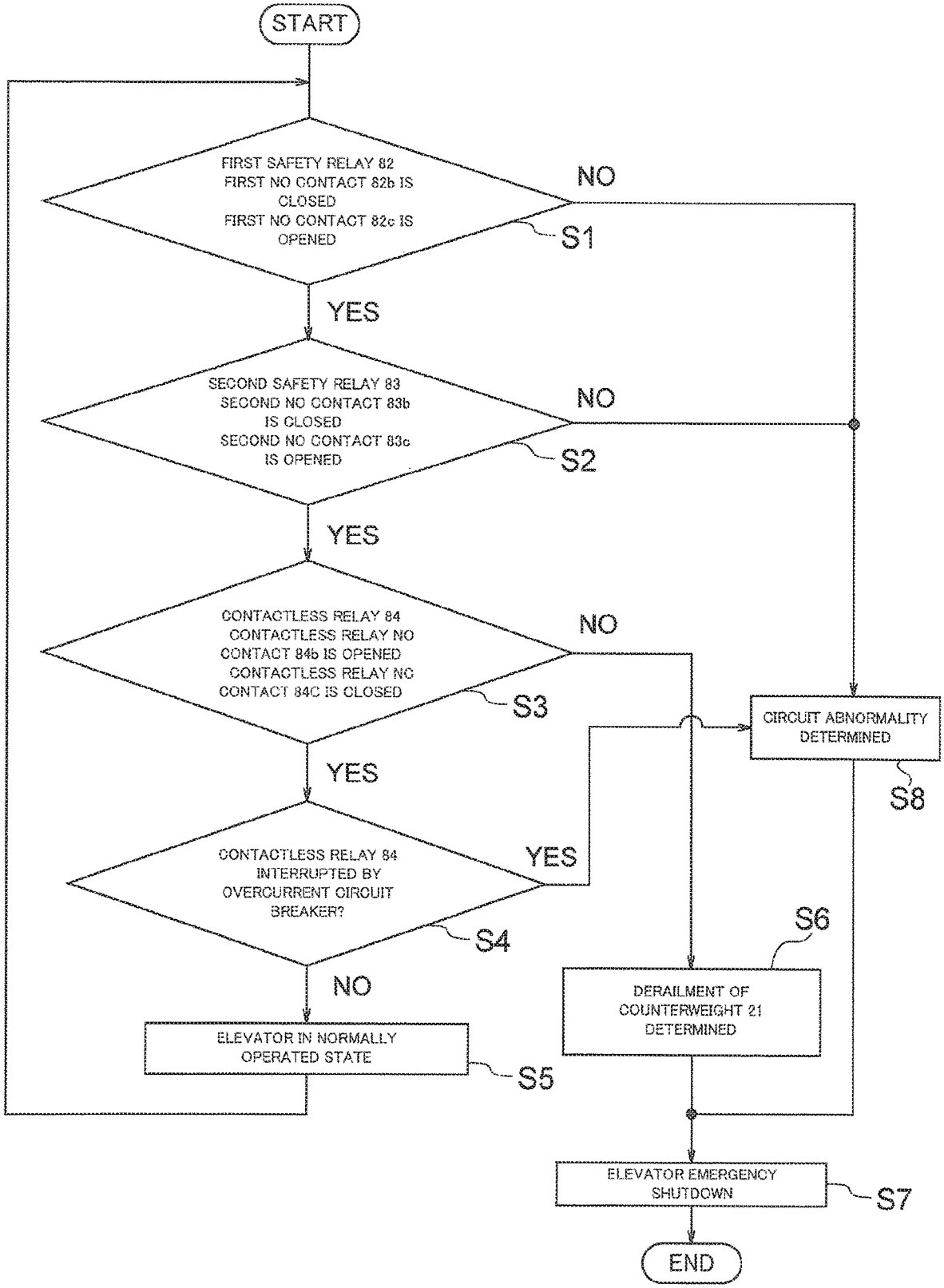
FIG. 4 is a flowchart for illustrating a determination condition while the elevator shown in FIG. 1 is in operation.

When it is determined that the counterweight 21 of the elevator 11 is in a derailed state (see B7 in FIG. 3), the relay detector 85 activates a stopper device (not shown) for the elevator 11 to shut down the elevator for emergency (see B8 in FIG. 3 and step S7 in FIG. 4). In this way, when the counterweight 21 is in a derailed state, the elevator 11 can be shut down for emergency and safety can be secured.

Now, operation carried out when the counterweight 21 is not derailed from the first guide rail 50 or the second guide rail 51 but there is an abnormality caused in the circuit (in the event of a circuit abnormality) of the elevator system 10 will be described. When an abnormality occurs in the circuit of the elevator system 10 (see C1 in FIG. 3), the opened and closed states of the contacts at the first safety relay 82, the second safety relay 83, and the contactless relay 84 detected by the relay detector 85 change from those in the normally operated state.

For example as shown in FIG. 1, when the safety device for the first DC power supply device 80 is activated and the output is stopped, no voltage is applied to the first coil 82*a*, so that the first NO contact 82*b* is opened, and the first NC contact 82*c* is closed. When the first conductor wire 60 is disconnected, no voltage is applied to the first coil 82*a*, so that the first NO contact 82*b* is opened, and the first NC contact 82*c* is closed. When the first coil 82*a* is disconnected and no longer excited, the first NO contact 82*b* is opened, and the first NC contact 82*c* is closed. When the relay detector 85 detects the occurrence of the state in which the first NO contact 82*b* is opened and the first NC contact 82*c* is closed (see C2 in FIG. 3) (see step S1 in FIG. 4), it is determined that a circuit failure has occurred (see step S8 in FIG. 4).

Then, when the safety device for the second DC power supply device 81 is activated and the output is stopped, no voltage is applied to the second coil 83*a*, so that the second NO contact 83*b* is opened, and the second NC contact 83*c* is closed. When the second conductor wire 61 is disconnected, no voltage is applied to the second coil 83*a*, so that the second NO contact 83*b* is opened, and the second NC contact 83*c* is closed. When the second coil 83*a* is disconnected and no longer excited, the second NO contact 83*b* is opened, and the second NC contact 83*c* is closed. When the relay detector 85 detects the occurrence of the state in which either the second NO contact 83*b* is opened or the second NC contact 83*c* is closed (see C2 in FIG. 3) (see step S2 in FIG. 4), it is determined that a circuit abnormality has occurred (see step S8 in FIG. 4).

When the contactless relay 84 is short-circuited, the contactless relay NO contact 84*b* is opened, the contactless relay NC contact 84*c* is closed (see C2 in FIG. 3), and the relay detector 85 detects the state (see step S3 in FIG. 4). Then, the relay detector 85 detects interruption of the circuit by the overcurrent circuit breaker provided at the contactless relay 84 (see step S4 in FIG. 4). In this way, the relay detector 85 determines that a circuit abnormality has occurred (see step S8 in FIG. 4).

When the relay detector 85 determines the occurrence of a circuit failure, the relay detector 85 activates the stopper device (not shown) for the elevator 11 to shut down the elevator for emergency (see B8 in FIG. 3 and step S7 in FIG. 4). In this way, in the event of a circuit failure in the elevator system 10, the elevator 11 can be shut down for emergency and safety can be secured.

In this way, the device includes the counterweight 21, the first and second guide rails 50 and 51 which guide the counterweight 21 to be lifted and lowered, the first and second conductor wires 60 and 61 provided in parallel to the lifting and lowering direction of the counterweight 21, the contacting means 71 as a conductor provided at the counterweight 21 and positioned in the vicinity of the first and second conductor wires 60 and 61, the first DC power supply device 80 which applies a first DC voltage to the first conductor wire 60, a second DC power supply device 81 which applies a second DC voltage to the second conductor wire 61, and a contactless relay 84 which detects a voltage at the second conductor wire 61, the first DC voltage and the second DC voltage have different voltage values, and when the counterweight 21 is derailed from the first or second guide rail 50 or 51, the contacting means 71 contacts the first and second conductor wires 60 and 61, the contactless relay 84 therefore operates to detect a DC voltage generated at the second conductor wire 61, so that the derailment of the counterweight 21 from the first or second guide rail 50 or 51 can surely be detected.

The contacting means 71 is provided at the counterweight 21 through the insulator 70 and has first and second contacting arms 72 and 73, and when the counterweight 21 is not derailed from the first or second guide rail 50 or 51, the first contacting arm 72 is in the vicinity of the first conductor wire 60 in a non-contact state, while the second contacting arm 73 is in the vicinity of the second conductor wire 61 in a non-contact state, so that the contacting means 71 can be lifted and lowered in the vicinity of the first and second conductor wires 60 and 61 in response to lifting and lowering of the counterweight 21.

The first DC voltage has a higher value than the second DC voltage, and when the counterweight 21 is derailed from the first or second guide rail 50 or 51, the first contacting arm 72 contacts the first conductor wire 60 while the second contacting arm 73 contacts the second conductor wire 61, so that the first conductor wire 60 and the second conductor wire 61 are electrically connected with each other, the first DC voltage is applied to the second conductor wire 61, and therefore the contactless relay 84 can surely be operated to detect the derailment of the counterweight 21 from the first or second guide rail 50 or 51 on the basis of the voltage difference in DC voltage and the low resistance of the contacting means 71 as compared to the conventional elevator derailment detecting device in which there is no potential difference among multiple conductor wires.

The contactless relay 84 is provided with the second DC voltage as an input when the counterweight 21 is not derailed from the first or second guide rail 50 or 51 and operated in response to input of a DC voltage higher than the second DC voltage when the counterweight 21 is derailed from the first or second guide rail 50 or 51, and therefore the derailment of the counterweight 21 from the first or second guide rail 50 or 51 can surely be detected as the relay detector 85 detects the operation state of the contactless relay 84 as compared to the method for directly detecting current change in the conductor wires as in the conventional elevator derailment detecting device.

Since the first and second conductor wires 60 and 61 and the contacting means 71 are made of a corrosion resistant material or coated with a corrosion resistant material, the resistance thereof does not increase by corrosion.

Since the device includes the first failure detector 82 which detects an abnormality at the first DC power supply device 80 or a circuit connected to the first conductor wire 60 and a second failure detector 83 which detects an abnormality at the second DC power supply device 81 or a circuit connected to the second conductor wire 61, not only the derailed state of the elevator 11 but also a failure at wiring in the elevator system 10 can be determined.

Note that according to the embodiment, the first and second safety relays 82 and 83 are contact relays, while these relays may be contactless relays. In this case, connection with a means such as an overcurrent circuit breaker for detecting a short circuit caused by a failure in semiconductor inside and interrupting the circuit in order to prevent the circuit from becoming uninterruptible by a short-circuit in the contactless relay is required.

A contact relay may be used instead of the contactless relay 84. In this case, a contact relay with high corrosion resistance is preferably used, weak current is constantly passed through an NC contact as a measure against a contact failure caused by generation of an organic substance at an NO contact attributable to a chloride or a sulfide, while the operation of the NO contact and the NC contact during operation are preferably monitored by the relay detector 85, etc. as a measure against a contact failure.

The first DC power supply device outputs a DC voltage of 24 V, the second DC power supply device outputs a DC voltage of 12 V, the first safety relay 82 can operate when the input voltage to the first coil 82*a* is a DC voltage of 24 V, the second safety relay 83 can operate when the input voltage to the second coil 83*a* is in the range from 12 V to 24 V, the contactless relay 84 does not operate when the input voltage to the input element 84*a* is a DC voltage of 12 V, and the upper limit for the operation voltage thereof is set to a DC voltage of 24 V, while these output voltage values and the operation voltage values are simply examples and may be set to arbitrary values if the output voltages from the first DC power supply device and the second DC power supply device are different. In general, as the output voltage difference between the first DC power supply device and the second DC power supply device increases, the allowance range for the voltage drop used to detect different voltages can be increased.

The contacting means 71 is provided at the counterweight 21 while the elevator system may include the contacting means 71 provided at the cage 20 which forms the ascending and descending part and detect the derailment of the cage 20 from any of the guide rails.

REFERENCE SIGNS LIST

10 Elevator system
11 Elevator
21 Counterweight (ascending and descending part)
50 First guide rail (guide rail)
51 Second guide rail (guide rail)
60 First conductor wire
61 Second conductor wire
70 Insulator
71 Contacting means
72 First contacting arm
73 Second contacting arm
80 First DC power supply device (first DC power supply unit)
81 Second DC power supply device (second DC power supply unit)
82 First safety relay (first failure detector)
83 Second safety relay (second failure detector)
84 Contactless relay (different voltage detector)

The invention claimed is:

1. An elevator derailment detecting device, comprising:
an ascending and descending part;
a guide rail which guides the ascending and descending part to be lifted and lowered;
first and second conductor wires disposed parallel to a direction in which the ascending and descending part is lifted and lowered;
a contact as a conductor disposed at the ascending and descending part and positioned near the first and second conductor wires;
a first DC power supply unit which applies a first DC voltage to the first conductor wire; and
a second DC power supply unit which applies a second DC voltage to the second conductor wire; and
a different voltage detector which detects a voltage at the second conductor wire, wherein
the first and second DC voltages have different values, and
the contact contacts the first and second conductor wires when the ascending and descending part is derailed from the guide rail, so that a DC voltage is generated at the second conductor wire and detected by the different voltage detector.

2. The elevator derailment detecting device of claim 1, wherein the contact is disposed at the ascending and descending part through an insulator and has first and second contacting arms, and when the ascending and descending part is not derailed from the guide rail, the first contacting arm is located near the first conductor wire in a non-contact state, while the second contacting arm is located near the second conductor wire in a non-contact state.

3. The elevator derailment detecting device of claim 2, wherein the first DC voltage is higher than the second DC voltage, and when the ascending and descending part is derailed from the guide rail, the first contacting arm contacts the first conductor wire, and the second contacting arm contacts the second conductor wire, so that the first and second conductor wires are electrically connected with each other and the first DC voltage is applied to the second conductor wire.

4. The elevator derailment detecting device of claim 3, wherein the different voltage detector is a relay, and the different voltage detector is configured to operate in response to input of the second DC voltage when the ascending and descending part is not derailed from the guide rail and in response to input of a higher DC voltage than the second DC voltage when the ascending and descending part is derailed from the guide rail.

5. The elevator derailment detecting device of claim 1, wherein the first and second conductor wires and the contact are made of or coated with a corrosion-resisting material.

6. The elevator derailment detecting device of claim 1, further comprising:

a first failure detector which detects an abnormality in the first DC power supply unit or the circuit connected to the first conductor wire, and a second failure detector which detects an abnormality in the second DC power supply unit or the circuit connected to the second conductor wire.

7. The elevator derailment detecting device of claim 2, wherein the first and second conductor wires and the contact are made of or coated with a corrosion-resisting material.

8. The elevator derailment detecting device of claim 3, wherein the first and second conductor wires and the contact are made of or coated with a corrosion-resisting material.

9. The elevator derailment detecting device of claim 4, wherein the first and second conductor wires and the contact are made of or coated with a corrosion-resisting material.

10. The elevator derailment detecting device of claim 2, further comprising:

a first failure detector which detects an abnormality in the first DC power supply unit or the circuit connected to the first conductor wire, and a second failure detector which detects an abnormality in the second DC power supply unit or the circuit connected to the second conductor wire.

11. The elevator derailment detecting device of claim 3, further comprising:

a first failure detector which detects an abnormality in the first DC power supply unit or the circuit connected to the first conductor wire, and a second failure detector which detects an abnormality in the second DC power supply unit or the circuit connected to the second conductor wire.

12. The elevator derailment detecting device of claim 4, further comprising:

a first failure detector which detects an abnormality in the first DC power supply unit or the circuit connected to the first conductor wire, and a second failure detector which detects an abnormality in the second DC power supply unit or the circuit connected to the second conductor wire.

13. The elevator derailment detecting device of claim 5, further comprising:

a first failure detector which detects an abnormality in the first DC power supply unit or the circuit connected to the first conductor wire, and a second failure detector which detects an abnormality in the second DC power supply unit or the circuit connected to the second conductor wire.

14. The elevator derailment detecting device of claim 7, further comprising:

a first failure detector which detects an abnormality in the first DC power supply unit or the circuit connected to the first conductor wire, and a second failure detector which detects an abnormality in the second DC power supply unit or the circuit connected to the second conductor wire.

15. The elevator derailment detecting device of claim 8, further comprising:

a first failure detector which detects an abnormality in the first DC power supply unit or the circuit connected to the first conductor wire, and a second failure detector which detects an abnormality in the second DC power supply unit or the circuit connected to the second conductor wire.

16. The elevator derailment detecting device of claim 9, further comprising:

a first failure detector which detects an abnormality in the first DC power supply unit or the circuit connected to the first conductor wire, and a second failure detector which detects an abnormality in the second DC power supply unit or the circuit connected to the second conductor wire.

17. The elevator derailment detecting device of claim 1, wherein the first DC voltage is higher than the second DC voltage.

18. The elevator derailment detecting device of claim 1, wherein the contact is disposed at the ascending and descending part through an insulator and has first and second contacting arms, and when the ascending and descending part is derailed from the guide rail, the first contacting arm contacts the first conductor wire, and the second contacting arm contacts the second conductor wire, so that the first and second conductor wires are electrically connected with each other and the first DC voltage is applied to the second conductor wire.

* * * * *